US011525387B1

(12) United States Patent
Park et al.

(10) Patent No.: US 11,525,387 B1
(45) Date of Patent: Dec. 13, 2022

(54) COOLING SYSTEM OF HYBRID VEHICLE AND CONTROL METHOD FOR THE SAME

(71) Applicants: Hyundai Motor Company, Seoul (KR); Kia Corporation, Seoul (KR)

(72) Inventors: Junghoon Park, Anyang-si (KR); Jae Man Cho, Hwaseong-si (KR); Kyounghee Kim, Ansan-si (KR); WonGi Lee, Hwaseong-si (KR)

(73) Assignees: Hyundai Motor Company, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/743,952

(22) Filed: May 13, 2022

(30) Foreign Application Priority Data

Jun. 10, 2021 (KR) ..... 10-2021-0075184

(51) Int. Cl.
*F01P 7/16* (2006.01)
*F01P 3/20* (2006.01)
*F01P 7/14* (2006.01)

(52) U.S. Cl.
CPC ..... *F01P 7/165* (2013.01); *F01P 3/20* (2013.01); *F01P 2007/146* (2013.01); *F01P 2050/24* (2013.01)

(58) Field of Classification Search
CPC ..... F01P 3/02; F01P 3/20; F01P 7/14; F01P 7/165; F01P 7/167; F01P 5/10; F01P 11/00; F01P 2007/146; F01P 2050/22; F01P 2050/24; F01P 2060/18; F02M 26/28; F02M 26/33; F01N 5/02; F01N 2240/02; F01N 3/043; F01N 3/0205; F02B 29/0437; F02B 29/0443; Y02T 10/12; Y02T 10/40
See application file for complete search history.

(56) References Cited

U.S. PATENT DOCUMENTS

| | | | | |
|---|---|---|---|---|
| 11,073,069 | B1 * | 7/2021 | Park | F01P 3/18 |
| 11,283,088 | B2 * | 3/2022 | Seo | H01M 8/04074 |
| 2013/0167784 | A1 * | 7/2013 | Quix | F02M 26/33 123/41.1 |
| 2014/0245735 | A1 * | 9/2014 | Kuske | F02B 29/0468 60/599 |
| 2016/0169081 | A1 * | 6/2016 | Hosokawa | F02B 29/0443 123/41.08 |
| 2019/0271258 | A1 * | 9/2019 | Mendez Abrego | F01P 7/164 |

* cited by examiner

*Primary Examiner* — Audrey B. Walter
*Assistant Examiner* — Dapinder Singh
(74) *Attorney, Agent, or Firm* — Morgan, Lewis & Bockius LLP

(57) ABSTRACT

A cooling system of a hybrid vehicle include an engine, a drive motor, a main water pump, a cooling line, a heat-exchange line, a heater line on which a heater and an exhaust heat recovery device are provided, a coolant control valve unit selectively supplying coolant to the cooling line, the heat-exchange line and the heater line, a bypass line connecting the rear of the exhaust heat recovery device and the front of the heater, an auxiliary water pump that selectively supplies coolant from the exhaust heat recovery device to the front of the heater, a state measurement unit that measures an operation state of the vehicle and outputs a corresponding signal, and a controller configured for controlling operation of the engine, the drive motor, the main water pump, the coolant control valve unit and the auxiliary water pump according to the output signal of the state measurement unit.

16 Claims, 15 Drawing Sheets

FIG. 13

| | AEWP ON | | AEWP OFF |
|---|---|---|---|
| ITM State | Departure | Destination | All other conditions |
| | ① | ③,④,⑤,⑥ | |
| | ④ | ①,③ | |
| | ⑤ | ①,③ | |
| | ⑥ | ①,③ | |

COOLING SYSTEM OF HYBRID VEHICLE AND CONTROL METHOD FOR THE SAME

CROSS-REFERENCE TO RELATED APPLICATION

The present application claims priority to Korean Patent Application No. 10-2021-0075184 filed on Jun. 10, 2021, the entire contents of which is incorporated herein for all purposes by this reference.

BACKGROUND OF THE PRESENT DISCLOSURE

Field of the Present Disclosure

The present disclosure relates to a cooling system of a hybrid vehicle and control method for the same. More particularly, the present disclosure relates to a cooling system of a hybrid vehicle that can prevent damage to an exhaust heat recovery device and a control method for the same.

Description of Related Art

In the cooling system of a hybrid vehicle, a coolant control valve unit that controls the coolant flow in a plurality of cooling lines is used for enhancement of fuel efficiency and rapid engine warm-up.

Furthermore, there are cases where an exhaust heat recovery device is additionally applied to recover exhaust heat for enhancement of fuel efficiency.

However, the coolant control valve unit controls the coolant flow depending on the vehicle's operation status, but depending on the cooling operation mode, there are cases where the coolant does not flow to the exhaust heat recovery device and if coolant does not flow to the exhaust heat recovery device, the exhaust heat recovery device may be damaged.

That is, there is a possibility that the tube temperature in the exhaust heat recovery device rises rapidly and cracks occur.

Furthermore, in the EV mode that runs only with the operation motor, when the passenger operates the heater, the engine may be operated to increase the coolant temperature, which may reduce fuel efficiency.

The information included in this Background of the present disclosure section is only for enhancement of understanding of the general background of the present disclosure and may not be taken as an acknowledgement or any form of suggestion that this information forms the prior art already known to a person skilled in the art.

BRIEF SUMMARY

Various aspects of the present disclosure are directed to providing a cooling system of a hybrid vehicle and a control method for the same which may prevent damage to the exhaust heat recovery device.

Furthermore, the present disclosure is to provide a cooling system and a control method for a hybrid vehicle configured for improving fuel efficiency by minimizing engine operation when a passenger operates a heater in an EV mode driven only by an operation motor.

A cooling system of a hybrid vehicle according to various exemplary embodiments of the present disclosure may include an engine, a drive motor, a main water pump connected to the engine and selectively supplying coolant to the engine, a cooling line on which a radiator is provided, the cooling line fluidically communicating with the main water pump, a heat-exchange line on which a heat-exchange device is provided, the heat-exchange line fluidically communicating with the main water pump, a heater line on which a heater and an exhaust heat recovery device are provided, the heater line fluidically communicating with the main water pump, a coolant control valve unit fluidically communicating with the engine and selectively supplying coolant to the cooling line, the heat-exchange line and the heater line, a bypass line connecting the rear of the exhaust heat recovery device and the front of the heater, an auxiliary water pump that selectively supplies coolant from the exhaust heat recovery device to the front of the heater, a state measurement unit that is configured to measure an operation state of the vehicle and outputs a corresponding signal, and a controller configured for controlling operation of the engine, the drive motor, the main water pump, the coolant control valve unit and the auxiliary The state measurement unit may include an engine coolant temperature detector that is configured to measure a coolant temperature of the engine and outputs a corresponding signal, a heater line coolant temperature detector that is configured to measure a coolant temperature of the heater line and outputs a corresponding signal, an oil temperature detector that is configured to measure an oil temperature and outputs a corresponding signal, an atmosphere temperature detector that is configured to measure an outside air temperature and outputs a corresponding signal, an accelerator pedal detector that is configured to measure an accelerator opening and outputs a corresponding signal, a vehicle speed detector that is configured to measure a vehicle speed and outputs a corresponding signal, and a position detector that detects an operation of the coolant control valve unit and outputs a corresponding signal, wherein the controller may be configured to control the operation of the coolant control valve unit according to the output signal of the state measurement unit to adjust a coolant supply and an amount of coolant supply in the cooling line, the heat-exchange line and the heater line.

The controller may output a signal for driving the auxiliary water pump, when the controller concludes that the coolant supply of the heater line is stopped according to the output signal of the state measurement unit.

The controller may be configured to control the operation of the coolant control valve unit according to a plurality of operation modes of the coolant control valve unit, and the plurality of operation modes may include a heating priority mode to supply coolant only to the heater line, a flow stop mode to stop the coolant supply, a heat-exchange mode to supply coolant only to the heat-exchange line, a heating control mode to supply the coolant to the heater line while maximizing a coolant flow rate of the heat-exchange line, a coolant temperature control mode to supply the coolant to the cooling line while maximizing the coolant flow rate of the heat-exchange line and the heater line, and a maximum cooling mode to maximize coolant flow to the heat-exchange line, the heater line and the cooling line.

If the controller concludes that a current operation mode of the coolant control valve unit corresponds to the flow stop mode or the heat-exchange mode, or the controller concludes that the current operation mode of the coolant control valve unit goes through the flow stop mode or the heat-exchange mode, the controller may drive the auxiliary water pump.

The auxiliary water pump may include a first outlet fluidically communicating with the main water pump, and a second outlet fluidically communicating with the bypass line, wherein a T nipple may be provided at a connection portion of the bypass line and the heater line connecting the front of the heater.

The cooling system according to various exemplary embodiments of the present disclosure may further include a first T nipple fluidically communicating with the bypass line provided between the auxiliary water pump and the main water pump, and a second T nipple provided at a connection portion of the bypass line and the heater line connecting the front of the heater.

A diameter of the bypass line may be smaller than a diameter of the heater line.

A control method for a cooling system of a hybrid vehicle according to various exemplary embodiments of the present disclosure may include determining, by the controller, the operation mode of the coolant control valve unit according to the output signal of the state measurement unit, controlling, by the controller, the operation of the coolant control valve unit according to the output signal of the state measurement unit, detecting, by the controller, the operation state of the coolant control valve unit, determining by the controller whether the predetermined driving condition of the auxiliary water pump is satisfied, and driving the auxiliary water pump when the controller concludes that the predetermined driving condition of the auxiliary water pump is satisfied.

The control method according to various exemplary embodiments of the present disclosure may further include detecting by the controller the operation state of the coolant control valve unit, determining by the controller whether a predetermined driving release condition of the auxiliary water pump is satisfied, and stopping the auxiliary water pump when the controller concludes that the driving release condition of the auxiliary water pump is satisfied.

The predetermined driving condition of the auxiliary water pump may be satisfied when the operation mode of the coolant control valve unit is the heat-exchange mode to supply coolant only to the heat-exchange line, or the heating control mode to supply coolant to the heater line with the coolant flow rate of the heat-exchange line maximized, or when the operation mode of the coolant control valve unit goes through the heat-exchange mode or the heating control mode.

When the driving condition of the auxiliary water pump does not correspond to the predetermined driving condition of the auxiliary water pump, the predetermined driving release condition of the auxiliary water pump may be satisfied.

The control method according to various exemplary embodiments of the present disclosure may further include determining by the controller whether a current operation state of the vehicle is an EV driving mode that drives only the drive motor, determining by the controller whether a heater switch is in an ON state when the current operation state of the vehicle is the EV driving mode, determining by the controller whether the coolant temperature of the heater line exceeds a predetermined first coolant temperature when the heater switch is in the ON state, controlling by the controller the coolant control valve unit to be operated in the flow stop mode in which the coolant supply is stopped, or in the heat exchange mode to supply coolant only to the heat-exchange line when the coolant temperature exceeds the predetermined first coolant temperature, and driving the auxiliary water pump by the controller.

The control method according to various exemplary embodiments of the present disclosure may further include determining by the controller whether the coolant temperature of the heater line is less than a predetermined second coolant temperature, and releasing by the controller the operation of the auxiliary water pump and controlling the opening amount of the coolant control valve unit when the coolant temperature of the heater line is less than the predetermined second coolant temperature.

The second coolant temperature may be lower than the first coolant temperature.

According to various exemplary embodiments of the present disclosure of the hybrid vehicle cooling system and the control method for the same, it is possible to prevent damage to the exhaust heat recovery device.

Furthermore, according to the cooling system of a hybrid vehicle and the control method for the same according to various exemplary embodiments of the present disclosure, when the passenger operates the heater in the EV mode driven only by the operation motor, the engine operation may be minimized to improve fuel efficiency.

Furthermore, the effects obtainable or predicted by the exemplary embodiments of the present disclosure are to be included directly or implicitly in the detailed description of the exemplary embodiments of the present disclosure. That is, various effects predicted according to various exemplary embodiments of the present disclosure will be included in the detailed description to be described later.

The methods and apparatuses of the present disclosure have other features and advantages which will be apparent from or are set forth in more detail in the accompanying drawings, which are incorporated herein, and the following Detailed Description, which together serve to explain certain principles of the present disclosure.

BRIEF DESCRIPTION OF THE DRAWINGS

FIG. 13 is a table showing the driving condition and release condition of the auxiliary water pump of the cooling system of the hybrid vehicle according to various exemplary embodiments of the present disclosure.

Figure 1:
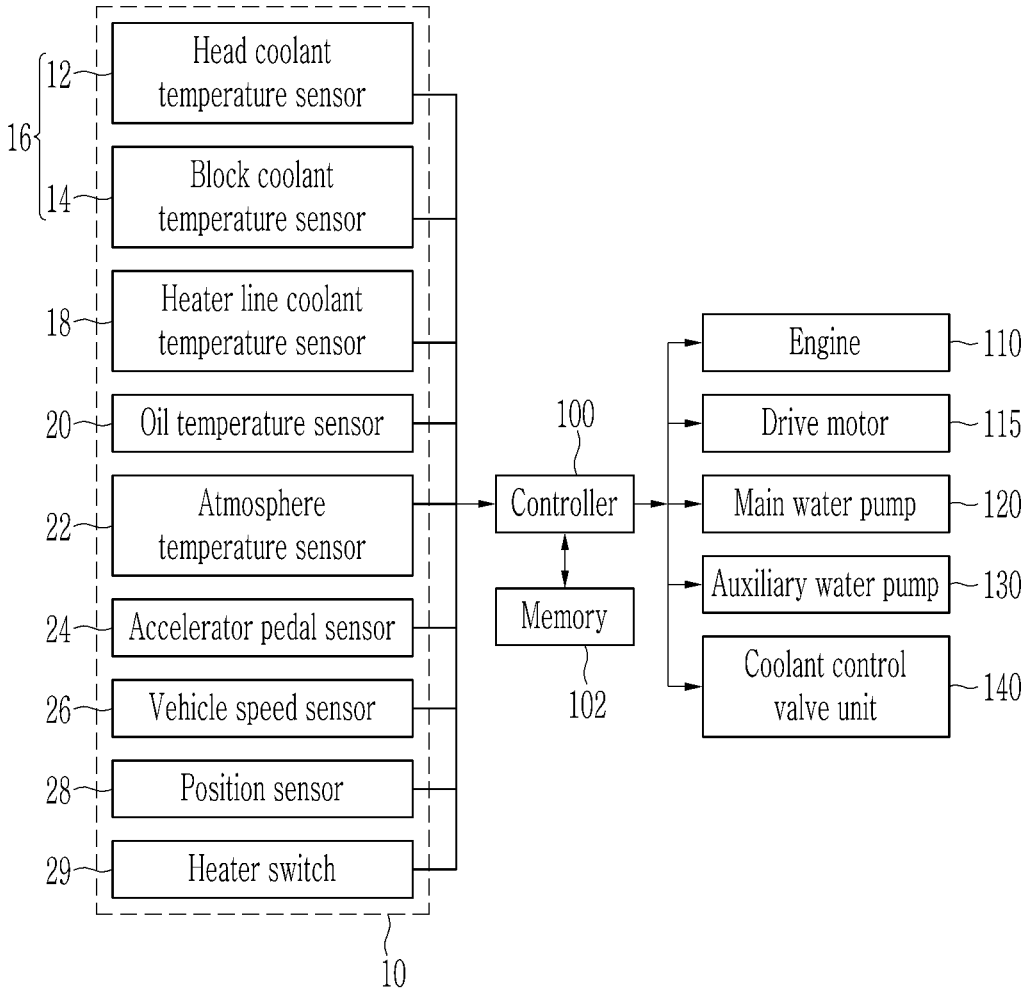
FIG. 1 is a block diagram of a cooling system of a hybrid vehicle according to various exemplary embodiments of the present disclosure.

It may be understood that the appended drawings are not necessarily to scale, presenting a somewhat simplified representation of various features illustrative of the basic principles of the present disclosure. The specific design features of the present disclosure as included herein, including, for example, specific dimensions, orientations, locations, and shapes will be determined in part by the particularly intended application and use environment.

In the figures, reference numbers refer to the same or equivalent parts of the present disclosure throughout the several figures of the drawing.

DETAILED DESCRIPTION

Reference will now be made in detail to various embodiments of the present disclosure(s), examples of which are illustrated in the accompanying drawings and described below. While the present disclosure(s) will be described in conjunction with exemplary embodiments of the present disclosure, it will be understood that the present description is not intended to limit the present disclosure(s) to those exemplary embodiments of the present disclosure. On the other hand, the present disclosure(s) is/are intended to cover not only the exemplary embodiments of the present disclosure, but also various alternatives, modifications, equivalents and other embodiments, which may be included within the spirit and scope of the present disclosure as defined by the appended claims.

Exemplary embodiments of the present disclosure will be described more fully hereinafter with reference to the accompanying drawings, in which exemplary embodiments of the present disclosure are shown. As those skilled in the art would realize, the described embodiments may be modified in various different ways, all without departing from the spirit or scope of the present disclosure.

To clearly explain an exemplary embodiment of the present disclosure, parts irrelevant to the description are omitted, and the same reference numerals are assigned to the same or similar elements throughout the specification.

Because the size and thickness of each component shown in the drawings are arbitrarily indicated for convenience of description, the present disclosure is not necessarily limited to that shown in the drawings, and the thickness is enlarged to clearly express various portions and regions.

Furthermore, in the following detailed description, the names of the components are divided into first, second, and the like to distinguish them in the same relationship, and the order is not necessarily limited in the following description.

Throughout the specification, when a part includes a certain component, it means that other components may be further included, rather than excluding other components, unless otherwise stated.

Furthermore, terms such as . . . part, . . . means described in the specification mean a unit of a comprehensive configuration that performs at least one function or operation.

When a part, such as a layer, film, region, plate, etc., is "on" another part, it includes not only the case where it is directly above the other part, but also the case where there is another part in between.

In contrast, when an element is referred to as being "directly on" another element, there are no intervening elements present.

Various exemplary embodiments of the present disclosure will hereinafter be described in detail with reference to the accompanying drawings.

FIG. 1 is a block diagram of a cooling system of a hybrid vehicle according to various exemplary embodiments of the present disclosure.

A cooling system of a hybrid vehicle according to various exemplary embodiments of the present disclosure may include a state measurement unit 10 that is configured to measure operation state of a vehicle and outputs the corresponding signal, and a controller 100 that controls operations of an engine 110, a drive motor 115, a main water pump 120, a coolant control valve unit 140 and an auxiliary water pump 130 according to the output signal of the state measurement unit 10.

The drive motor 115 may be a motor-generator, and depending on the combination of the engine 110 and drive motor 115, an EV mode in which only the drive motor 115 is driven, an HEV mode in which simultaneously the engine 110 and the drive motor 115 are driven, and an engine mode in which only the engine 110 is driven are possible.

The controller 100 may each be implemented by at least one microprocessor operating according to a predetermined program, and the predetermined program may include a series of instructions for performing a method according to various exemplary embodiments of the present disclosure to be described later.

The cooling system of the hybrid vehicle according to various exemplary embodiments of the present disclosure may further include a memory 102, and a series of instructions for performing a method according to various exemplary embodiments of the present disclosure to be described later are stored in the memory 102.

The main water pump 120 and the auxiliary water pump 130 may be electric water pumps whose operation and rotation speed are controlled by the controller 100.

Figure 2:
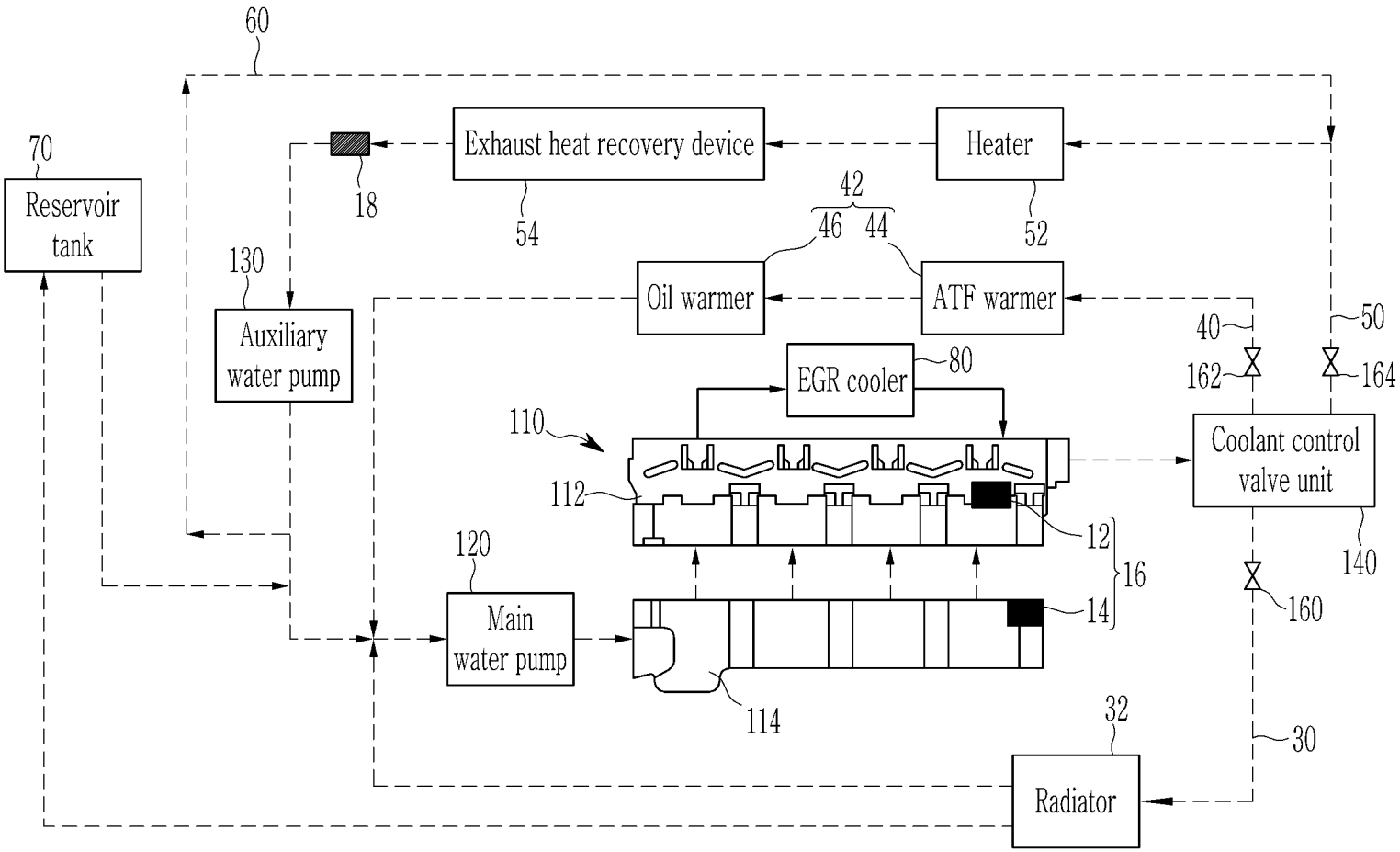
FIG. 2 is a schematic diagram of the cooling system of a hybrid vehicle according to various exemplary embodiments of the present disclosure.

FIG. 2 is a schematic diagram of the cooling system of a hybrid vehicle according to various exemplary embodiments of the present disclosure.

Referring to FIG. 1 and FIG. 2, the cooling system of the hybrid vehicle according to various exemplary embodiments of the present disclosure may include the main water pump 120, which selectively supplies coolant to the engine 110, a cooling line 30 which communicates with the main water pump 120 and of which a radiator 32 is provided thereon, a heat-exchange line 40 which communicates with the main water pump 120 and of which a heat-exchange device 42 is provided thereon, a heater line 50 which communicates with the main water pump 120 and of which a heater 52 and an exhaust heat recovery device 54 are provided thereon, the coolant control valve unit 140, which communicates with the engine 110 and selectively supplies coolant to the cooling line 30, the heat-exchange line 40 and the heater line 50, a bypass line 60 connecting the rear of the exhaust heat recovery device 54 and the front of the heater 52, and the auxiliary water pump 130 that selectively supplies coolant that has passed the exhaust heat recovery device 54 to the front of the heater 52.

The cooling system of the hybrid vehicle according to various exemplary embodiments of the present disclosure may further include an exhaust gas recirculation (EGR) cooler 80 which is connected to the engine 110 and receives coolant from the engine 110.

The heat-exchange device 42 may include, for example, an ATF warmer 44 and an oil warmer 46.

The cooling system of the hybrid vehicle according to various exemplary embodiments of the present disclosure may further include a reservoir tank 70 communicating with the radiator 32 and the heater line 50.

The state measurement unit 10 may include an engine coolant temperature detector 16, which measures the coolant temperature of the engine 110 and outputs a corresponding signal, a heater line coolant temperature detector 18, which measures the coolant temperature of the heater line 50 and outputs a corresponding signal, an oil temperature detector 20 that is configured to measure the oil temperature and outputs a corresponding signal, an atmosphere temperature detector 22 that is configured to measure the outside air temperature and outputs a corresponding signal, an accelerator pedal detector 24 that is configured to measure an accelerator opening and outputs a corresponding signal, a vehicle speed detector 26 that is configured to measure a vehicle speed and outputs a corresponding signal, and a position detector 28 that detects the operation of the coolant control valve unit 140 and outputs a corresponding signal. Additionally, the state measurement unit 10 may further include a heater switch 29 for driving the heater 52 by a passenger of the vehicle.

The engine 110 includes a cylinder head 112 and a cylinder block 114, and the engine coolant temperature detector 16 may include a head coolant temperature detector 12 that is configured to measure the coolant temperature passing through the cylinder head 112 and outputs the corresponding signal and a block coolant temperature detector 14 that is configured to measure the coolant temperature passing through the cylinder block 114 and outputs the corresponding signal.

The controller 100 may control the operation of the coolant control valve unit 140 according to the output signal of the state measurement unit 10, and through this, the controller 100 may control the coolant supply and the amount of coolant supply to the cooling line 30, the heat-exchange line 40 and the heater line 50.

Figure 3:
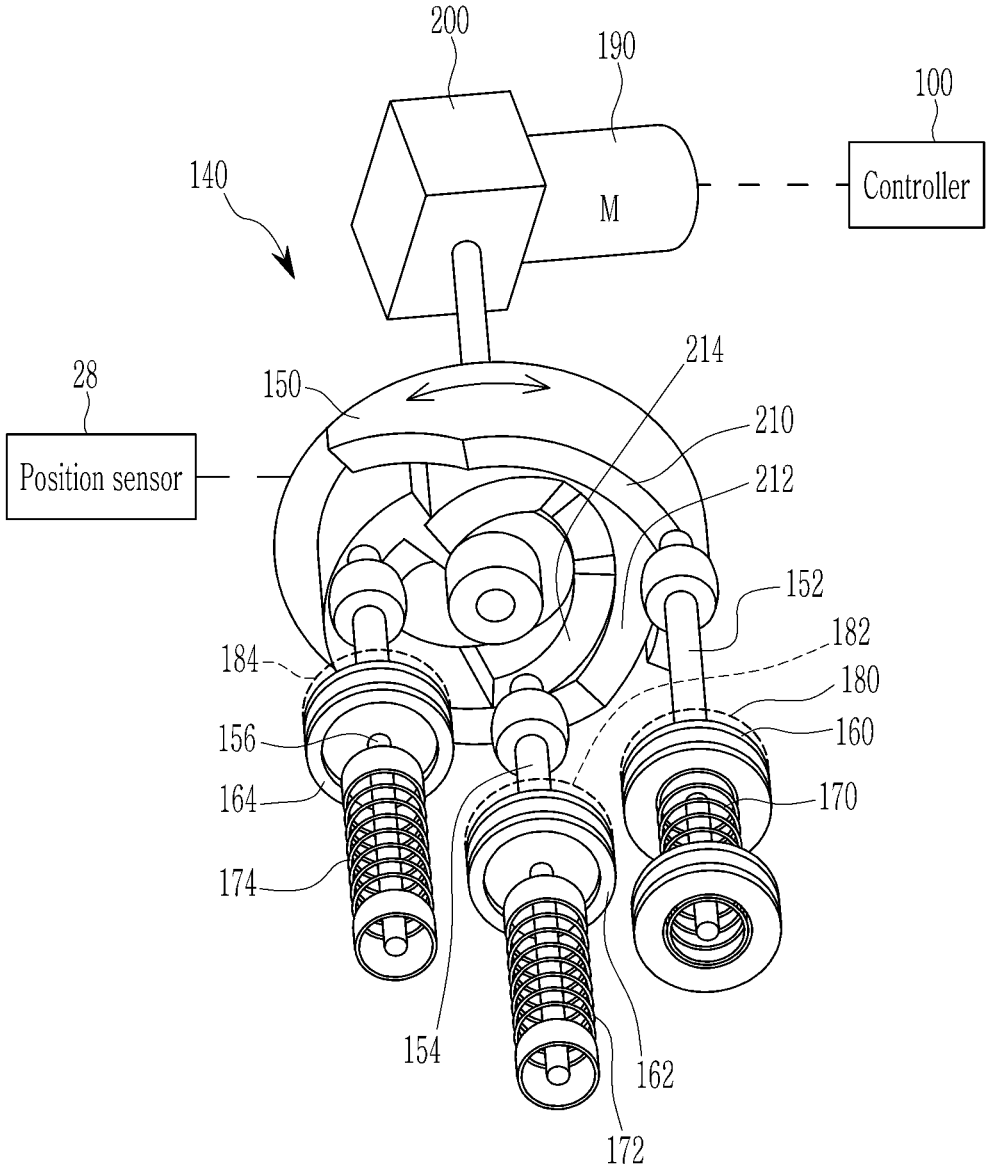
FIG. 3 is a perspective view of the coolant control valve unit which may be applied to a cooling system of a hybrid vehicle according to various exemplary embodiments of the present disclosure.

FIG. 3 is a perspective view of the coolant control valve unit which may be applied to a cooling system of a hybrid vehicle according to various exemplary embodiments of the present disclosure.

Referring to FIG. 1 to FIG. 3, the coolant control valve unit 140 includes a cam 150, tracks formed on the cam 150, rods contacting with the tracks, valves coupled to the rods and elastic members elastically supporting the valves, and the valves open or close the coolant passage.

A plurality of tracks, for example, first, second, and third tracks 210, 212, and 214 having a predetermined inclination and height are formed in the lower portion of the cam 150, and the rod, for example first, second, and third rod 152, 154, and 156 are provided. and according to the rotation position of the cam 150, each of the rods 152, 154, and 156 in contact with the tracks 210, 212, and 214 may move downwards.

And, the elastic member, for example, first, second, and third elastic members 170, 172, and 174 are provided to elastically support each rod 152, 154, and 156.

As each elastic member 170, 172, and 174 is compressed according to the rotation position of the cam 150, the first, second, and third valves 160, 162, and 164 mounted on each rod 152, 154, and 156 may open or close the first, second and the third coolant passage 180, 182, and 184. Here, the opening rate of each coolant passage may be controlled according to the rotation position of the cam 150.

The controller 100 controls the motor 190 based on the vehicle operation conditions, (e.g., coolant temperature, oil temperature, outside temperature, vehicle speed, etc.) and the position of the cam 150 received from the position detector 28, and the motor 190 changes the rotation position of the cam 150 through the gear box 200.

The position detector 28 may be a detector that directly detects the rotation position of the cam 150 as well as the controller 100 may indirectly determine the rotation position of the cam 150 by detecting the rotation position of the motor 190 through a resolver.

For example, the first coolant passage 180 may supply coolant to the cooling line 30, the second coolant passage 182 may supply coolant to the heat-exchange line 40, and the third coolant passage 184 may supply coolant to the heater line 50.

Figure 4:
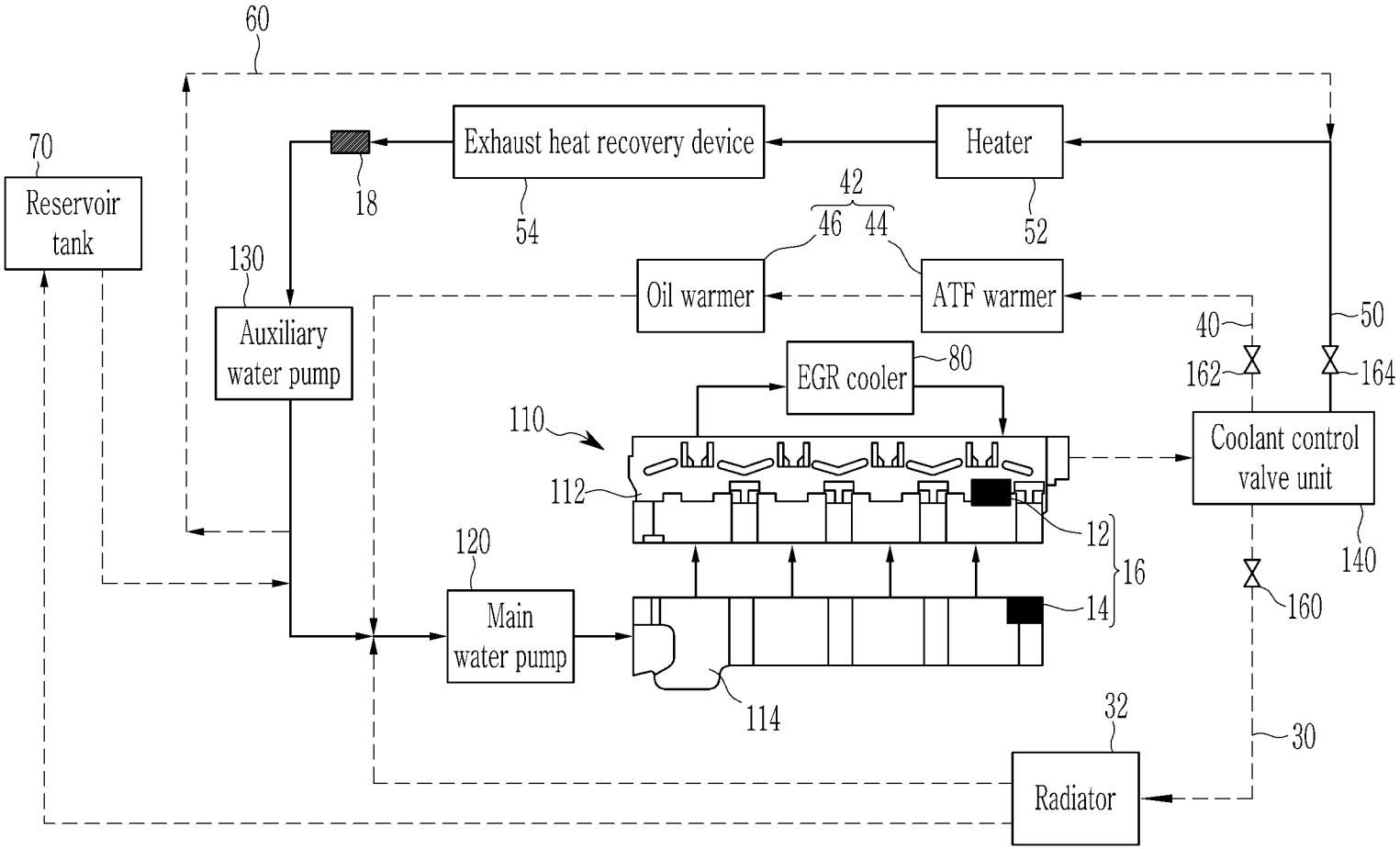
FIG. 4, FIG. 5, FIG. 6, FIG. 7, FIG. 8 and FIG. 9 are drawing showing operation of the cooling system of a hybrid vehicle according to various exemplary embodiments of the present disclosure.

FIG. 4 is a drawing showing the operation of the cooling system of the hybrid vehicle according to various exemplary embodiments of the present disclosure, and shows the coolant supply in the heating priority mode.

The controller 100 may control the operation of the coolant control valve unit 140 according to predetermined operation modes of the coolant control valve unit in advance. The operation modes of the coolant control valve unit may be stored in the memory 102.

Referring to FIG. 1, FIG. 2, FIG. 3, and FIG. 4, the plurality of operation modes include a heating priority mode to supply coolant only to the heater line 50.

For example, the heating priority mode may be operated when heating inside the vehicle is required immediately after starting in winter.

That is, according to the output signal of the state measurement unit 10 including the heater switch 29, the controller 100 supplies coolant only to the heater line 50 provided with the heater 52. That is, the controller 100 rotates the cam 150 so that only the third valve 164 is opened. Accordingly, the coolant that has passed through the engine 110 may raise the internal temperature of the vehicle via the heater 52.

Figure 5:
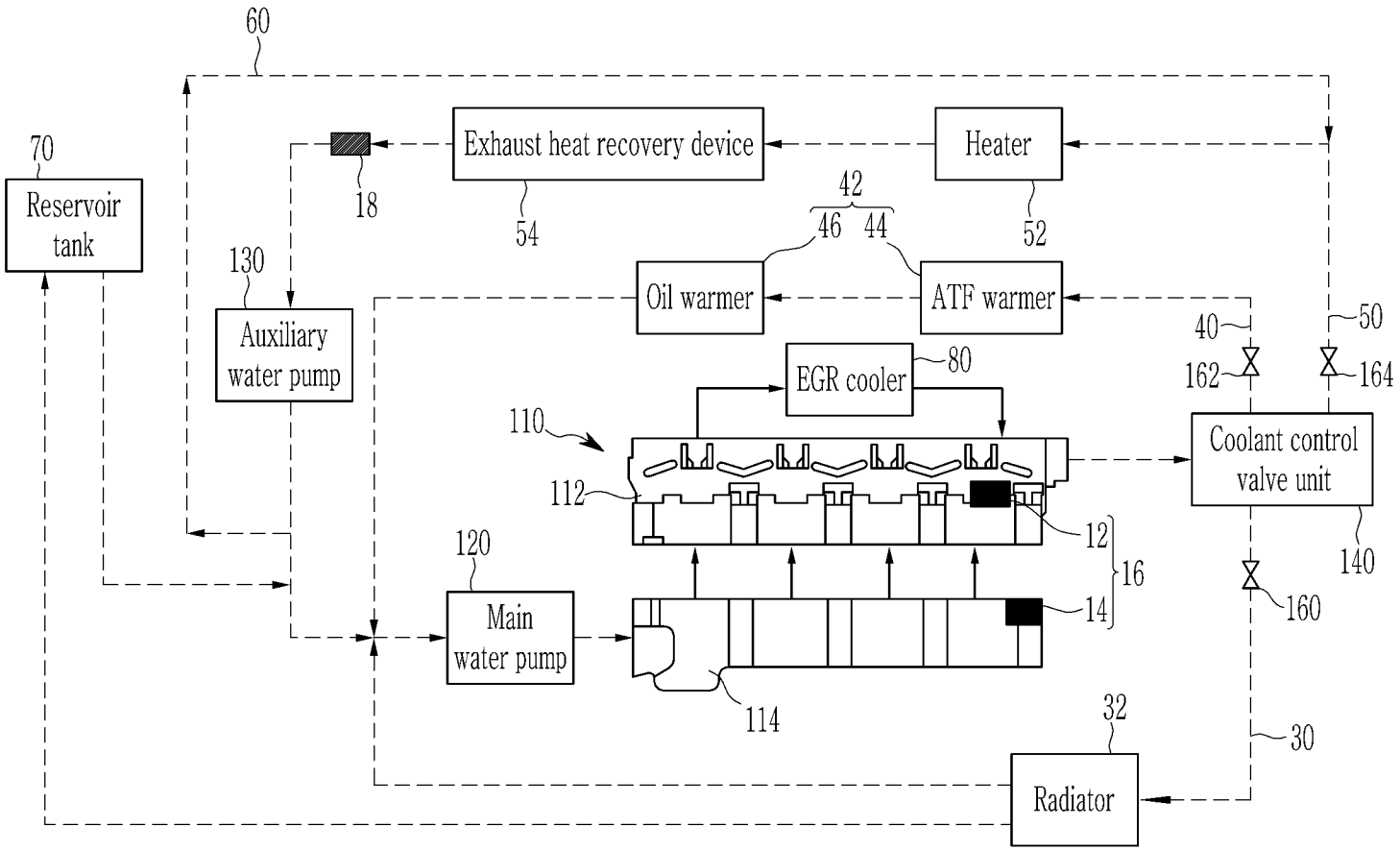

FIG. 5 is a drawing showing the operation of the cooling system of the hybrid vehicle according to various exemplary embodiments of the present disclosure, and shows the coolant supply in the flow stop mode.

Referring to FIG. 1 to FIG. 3 and FIG. 5, the plurality of operation modes include a flow stop mode stop the coolant supply.

For example, the flow stop mode may be operated when a quick warm-up of the engine 110 is required.

That is, the controller 100 controls the operation of the motor 190 of the coolant control valve unit 140 to stop the coolant flow according to the output signal of the state measurement unit 10 including the engine coolant temperature detector 16. That is, the controller 100 rotates the cam 150 and controls so that the first, second, and third valves 160, 162, and 164 are all closed to perform a rapid warm-up of the engine 110.

Figure 6:
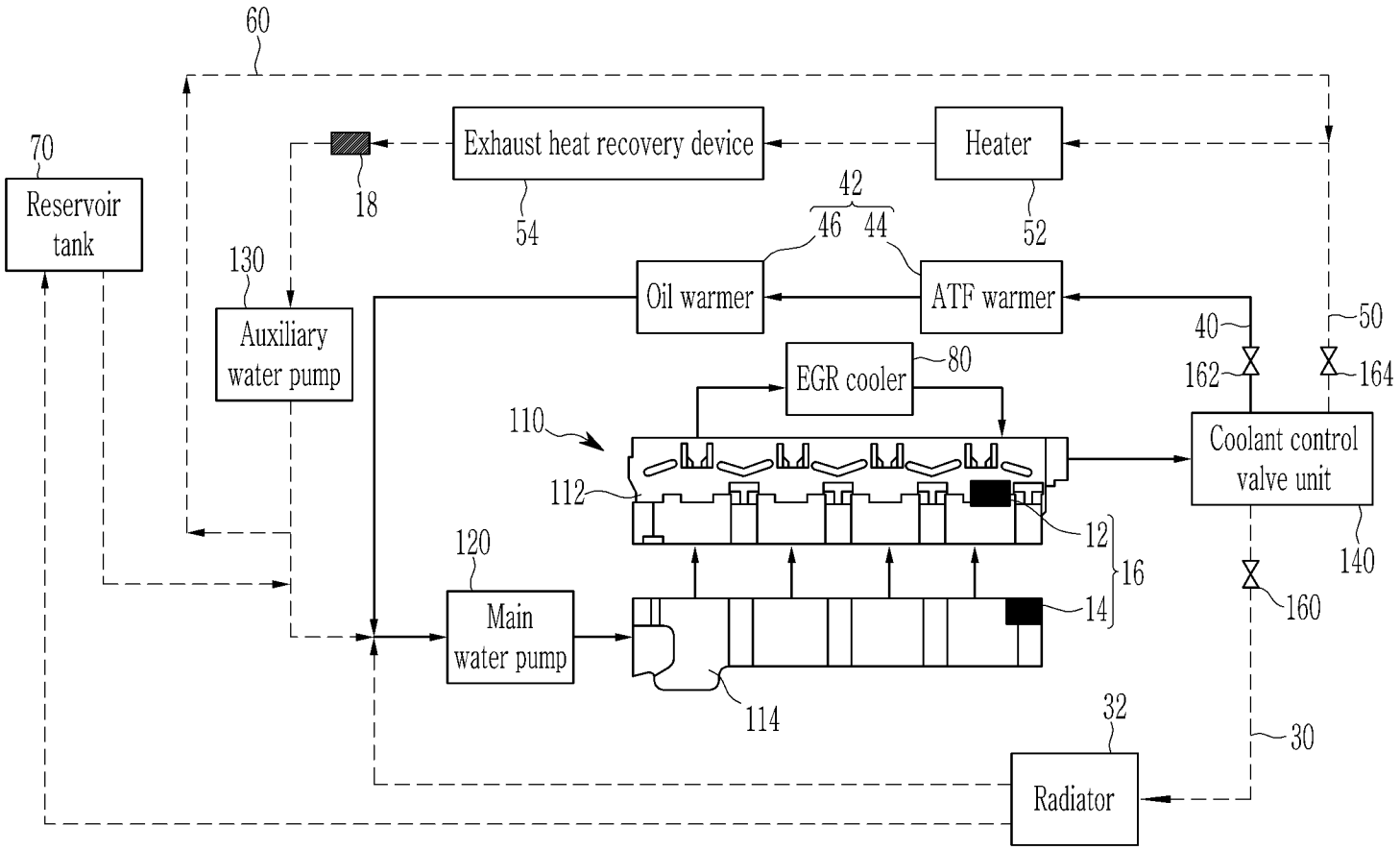

FIG. 6 is a drawing showing the operation of the cooling system of the hybrid vehicle according to various exemplary embodiments of the present disclosure, and shows the coolant supply in the heat-exchange mode.

Referring to FIG. 1 to FIG. 3 and FIG. 6, the plurality of operation modes includes a heat-exchange mode to supply coolant only to the heat-exchange line 40.

For example, when the engine 110 is heated up through the flow stop mode and the temperature of the Automatic Transmission Fluid (ATF) warmer 44 and the oil warmer 46 is required to be increased, the heat exchange mode may be performed. Conversely, when cooling of the ATF warmer 44 and the oil warmer 46 is required, the heat exchange mode may be performed to supply coolant.

That is, the controller 100 controls the operation of the motor 190 of the coolant control valve unit 140 to control the oil temperature according to the output signal of the state measurement unit 10 including the oil temperature detector 20. That is, the controller 100 rotates the cam 150 to control the opening of the second valve 162 to control the oil temperature.

Figure 7:
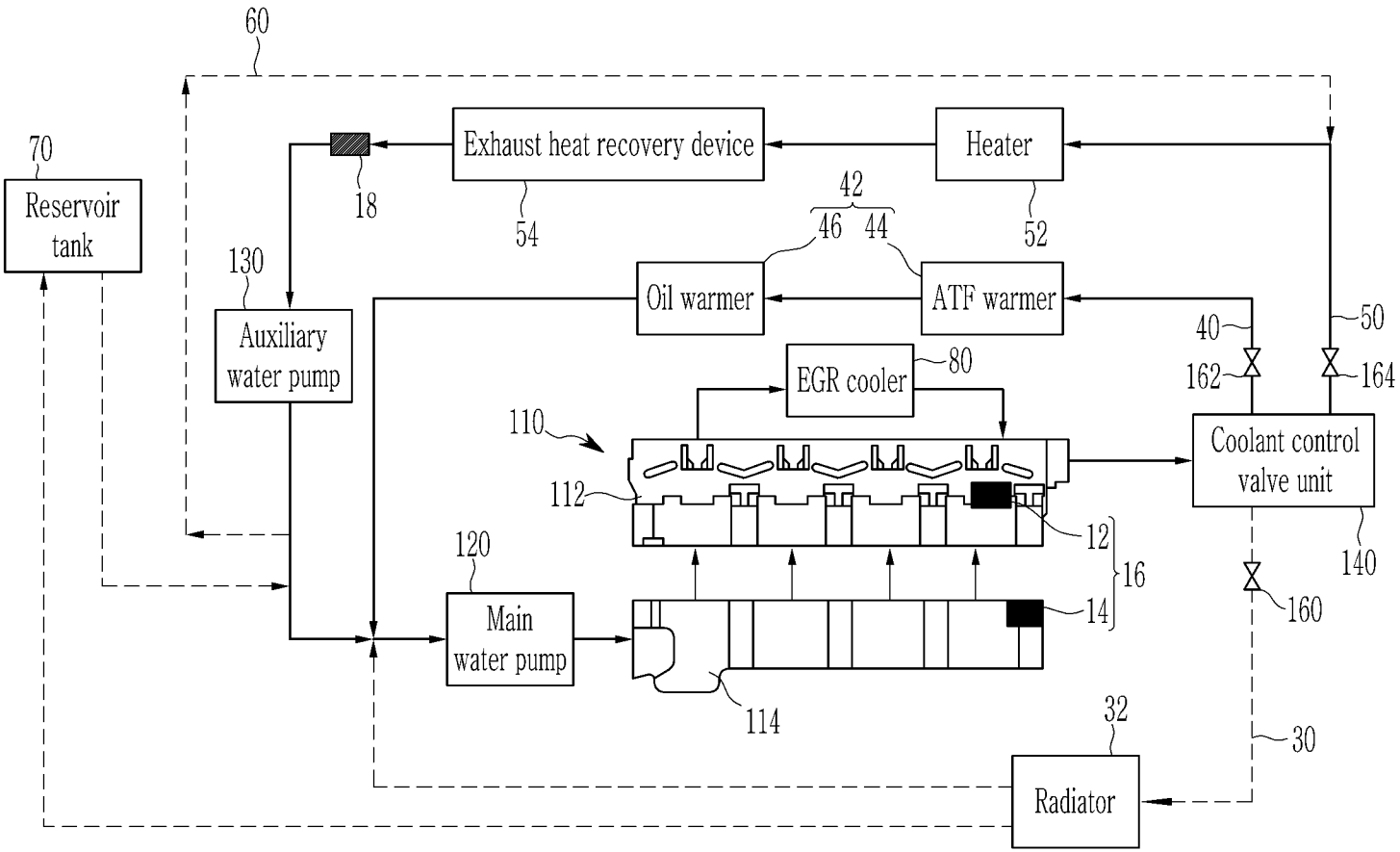

FIG. 7 is a drawing showing the operation of the cooling system of the hybrid vehicle according to various exemplary embodiments of the present disclosure, and shows the coolant supply in the heating control mode.

Referring to FIG. 1 to FIG. 3 and FIG. 7, the plurality of operation modes includes a heating control mode to supply coolant to the heater line 50 while maximizing the coolant flow rate of the heat-exchange line 40.

For example, the heating control mode may be operated when heating is required after the vehicle has been running for some time after starting.

That is, the controller 100 controls the operation of the motor 190 of the coolant control valve unit 140 when the vehicle has been operated for a predetermined time period or the coolant temperature is higher than the predetermined temperature, and the heater switch 29 is turned on according to the output signal of the operation state signal unit 10 including the heater switch 29. That is, the controller 100 rotates the cam 150 to control the opening of the third valve 164 while the second valve 162 is in the open state.

Figure 8:
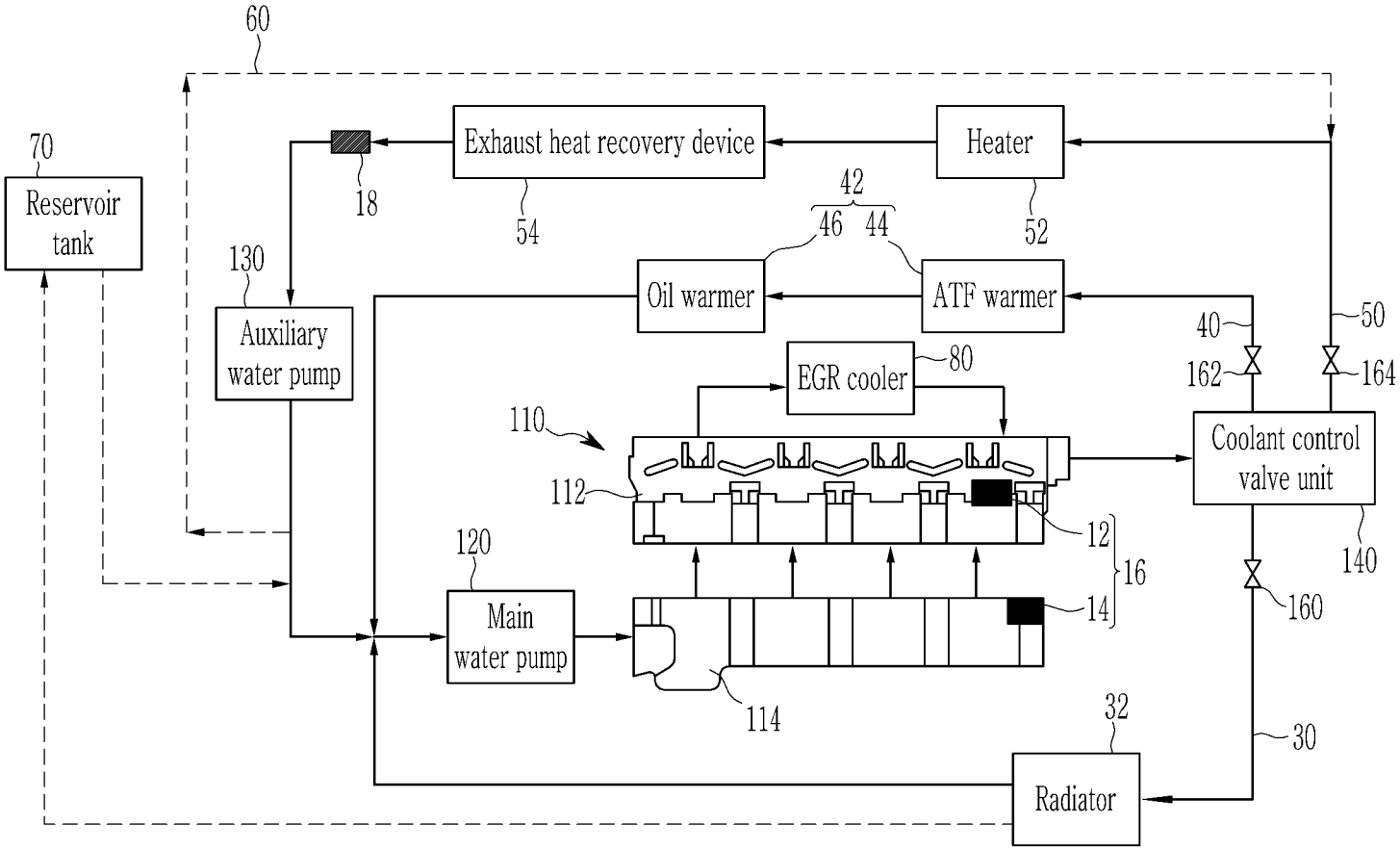

FIG. 8 is a drawing showing the operation of the cooling system of the hybrid vehicle according to various exemplary embodiments of the present disclosure, and shows the coolant supply in the coolant temperature control mode.

Referring to FIG. 1 to FIG. 3 and FIG. 8, the plurality of operation modes includes a coolant temperature control mode to supply coolant to the cooling line 30 while maximizing the coolant flow rate of the heat-exchange line 40 and the heater line 50.

For example, the coolant temperature control mode may be operated when cooling of the engine 110 is required.

That is, the controller 100 controls the operation of the motor 190 of the coolant control valve unit 140 when cooling of the engine 110 is required according to the output signal of the state measurement unit 10 including the engine coolant temperature detector 16. The controller 100 rotates the cam 150 to control the opening of the first valve 160 when the second valve 162 and the third valve 164 are in the open state. When the first valve 160 is opened, coolant may heat-exchange at the radiator 32 to cool the engine 110.

The operation condition of the coolant temperature control mode may be set separately according to the output signals of the head coolant temperature detector 12 and the block coolant temperature detector 14, and may be set in consideration of the damage prevention of the engine 110 and the appropriate viscosity of lubricant.

Furthermore, the plurality of operation modes further includes a maximum cooling mode to maximize coolant flow to the heat-exchange line 40, the heater line 50 and the cooling line 30.

For example, the maximum cooling mode may be operated when rapid cooling of the engine 110 is required.

When rapid cooling of the engine 110 is required according to the output signal of the state measurement unit 10 including the engine coolant temperature detector 16, the controller 100 controls the operation of the motor 190 of the coolant control valve unit 140. That is, the controller 100 rotates the cam 150 so that the first valve 160, the second valve 162 and the third valve 164 are maximally opened.

The operation condition of the maximum cooling mode may be set separately according to the output signal of the head coolant temperature detector 12 and the block coolant temperature detector 14, and may be set in consideration of the damage prevention of the engine 110 and the appropriate viscosity of lubricant. When the first valve 160 is fully opened, coolant may heat-exchange at the radiator 32 to rapidly cool the engine 110.

Figure 9:
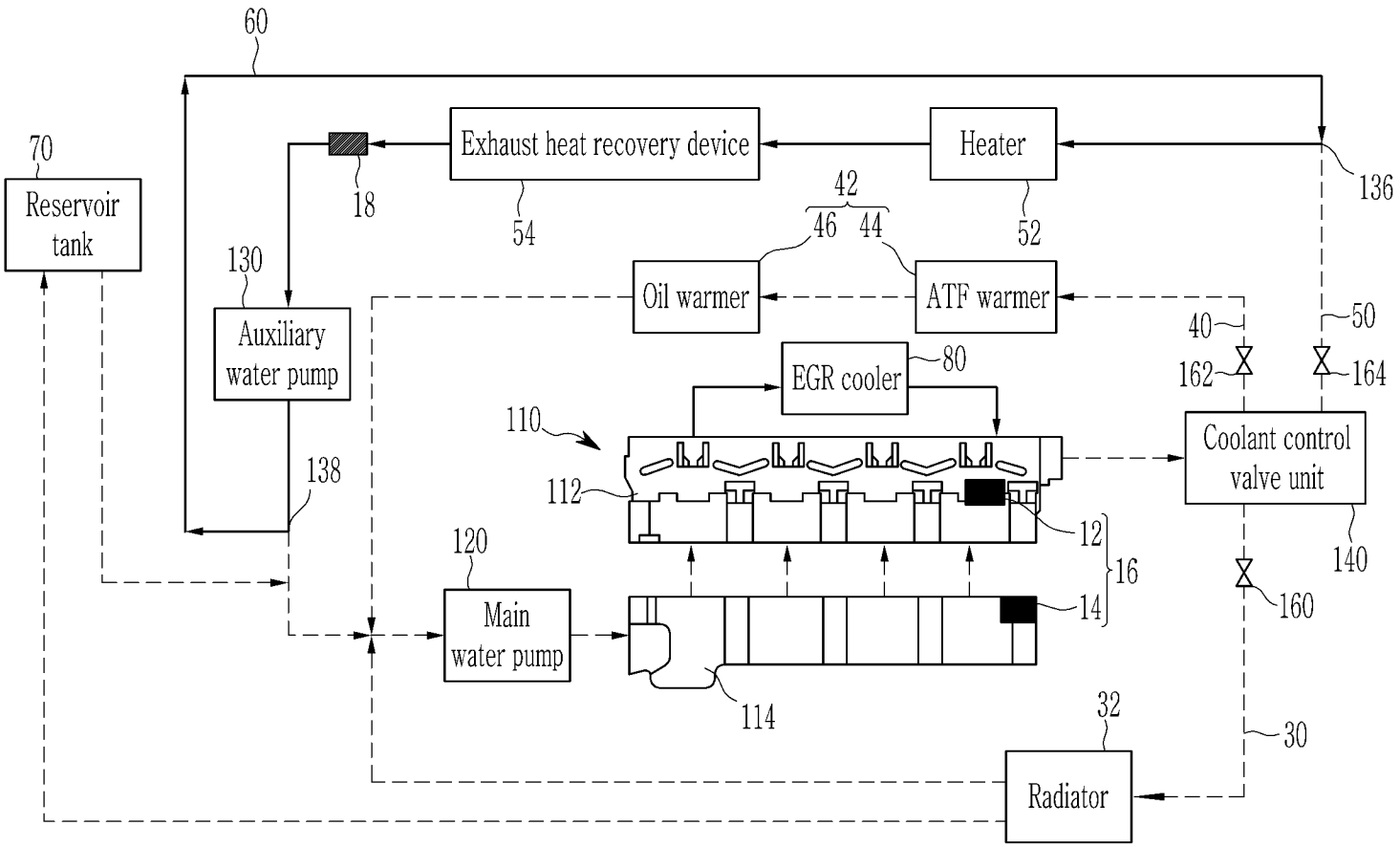

FIG. 9 is a drawing showing the operation of the cooling system of the hybrid vehicle according to various exemplary embodiments of the present disclosure, and shows the coolant supply when the auxiliary water pump 130 operates.

When it is determined that the coolant supply of the heater line 50 is stopped according to the output signal of the state measurement unit 10, the controller 100 may output a signal for driving the auxiliary water pump 130.

When the controller 100 determines that the current operation mode of the coolant control valve unit 140 corresponds to the flow stop mode or the heat-exchange mode, or the controller 100 determines that the operation mode of the coolant control valve unit 140 goes through the flow stop mode or the heat-exchange mode, the controller 100 may drive the auxiliary water pump 130.

That is, if the current operation mode of the coolant control valve unit 140 corresponds to the flow stop mode or the heat-exchange mode, or passes through the flow stop mode or the heat-exchange mode, because coolant does not flow to the exhaust heat recovery device 54, there is a possibility that the exhaust heat recovery device 54 is damaged, that is, the tube temperature of the exhaust heat recovery device 54 rises rapidly and cracks may occur.

In the cooling system of the hybrid vehicle according to various exemplary embodiments of the present disclosure, the auxiliary water pump 130 may be driven to prevent damage to the exhaust heat recovery device 54. When the auxiliary water pump 130 is running, coolant flows to the bypass line 60 to prevent damage to the exhaust heat recovery device 54.

Figure 10:
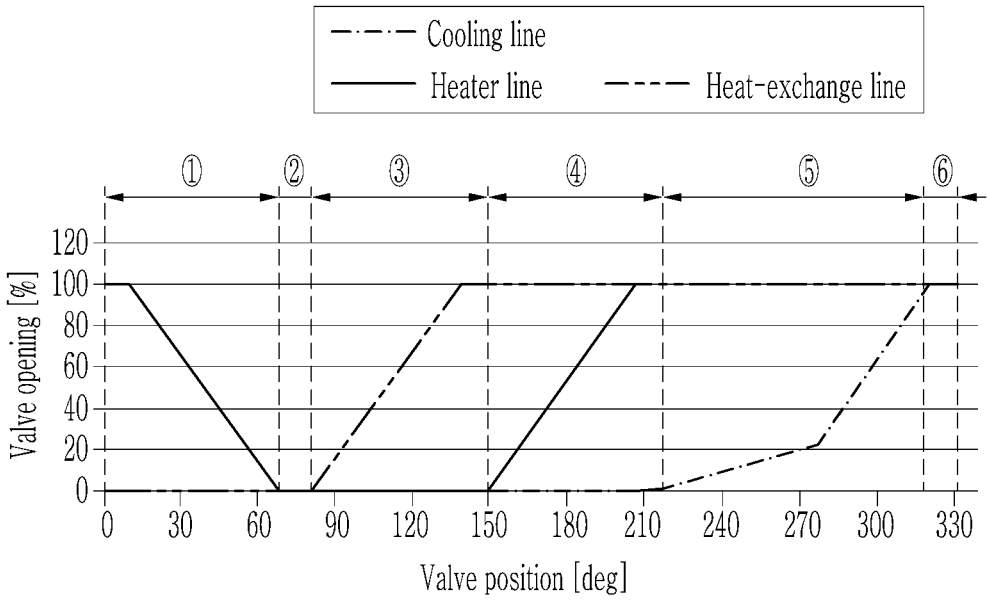
FIG. 10 is a graph showing valve opening amount of the coolant control valve unit which may be applied to the cooling system of a hybrid vehicle according to various exemplary embodiments of the present disclosure.

FIG. 10 is a graph showing valve opening amount of the coolant control valve unit which may be applied to the cooling system of a hybrid vehicle according to various exemplary embodiments of the present disclosure.

In the FIG. 10, sequentially from left to right, the valve opening according to the plurality of operation modes of the cooling system of the hybrid vehicle according to various exemplary embodiments of the present disclosure described above is shown.

The drawing shows that the maximum openings of the first, second, and third valves 160, 162, and 164 are the same, but this is an example, and the maximum openings of the first, second, and third valves 160, 162, and 164 are each independently may be set. For example, by adjusting the formation height of the first, second, and third tracks 210, 212, and 214, the maximum opening of the first, second, and third valves 160, 162, and 164 may be adjusted according to the heat-exchange required performance of each element.

As shown in the drawing, the cooling system of a hybrid vehicle according to various exemplary embodiments of the present disclosure performs ⓪ the heating priority mode, which supplies coolant only to the heater line 50 when heating inside the vehicle is needed immediately after starting in winter, and when the engine 110 needs a quick warm-up, perform ② the flow stop mode to stop the coolant supply.

When the control of lubricant temperature is required, the cooling system of the hybrid vehicle according to various exemplary embodiments of the present disclosure performs ③ the heat-exchange mode to supply coolant only to the heat-exchange line 40, and in the state that the coolant flow rate of the heat-exchange line 40 is maximized, perform ④ the heating control mode to supply coolant to the heater line 50.

Furthermore, in the cooling system of the hybrid vehicle according to various exemplary embodiments of the present disclosure, when cooling of the engine 110 is required, ⑤ the coolant temperature control mode to supply coolant to the cooling line 30 is performed while the coolant flow rate of the heat-exchange line 40 and the heater line 50 is maximized, and if rapid cooling of the engine 110 is required, perform ⑥ the maximum cooling mode that maximizes coolant flow through the heat-exchange line 40, the heater line 50 and the cooling line 30.

Figure 11:
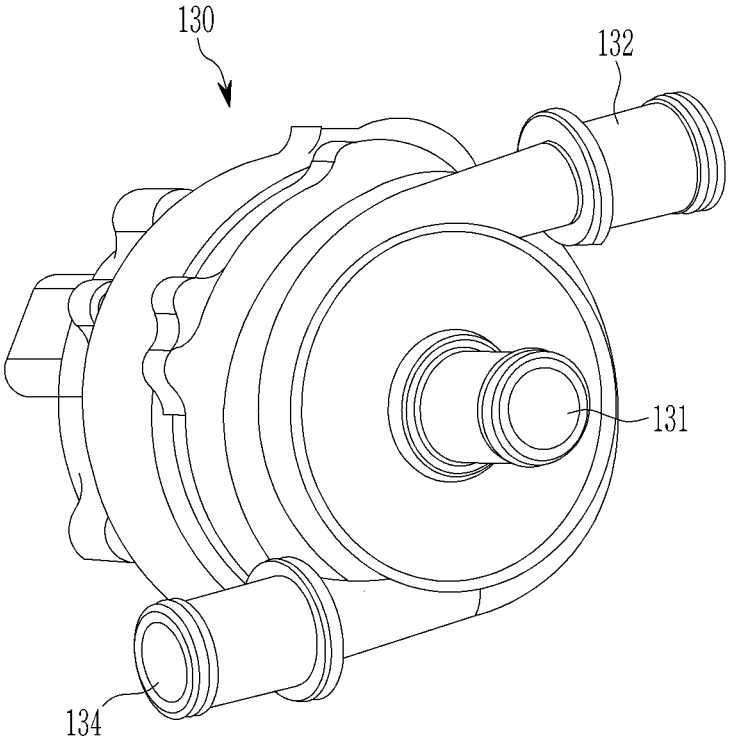
FIG. 11 is a perspective view of an auxiliary water pump which may be applied to the cooling system of a hybrid vehicle according to various exemplary embodiments of the present disclosure.
Figure 12:
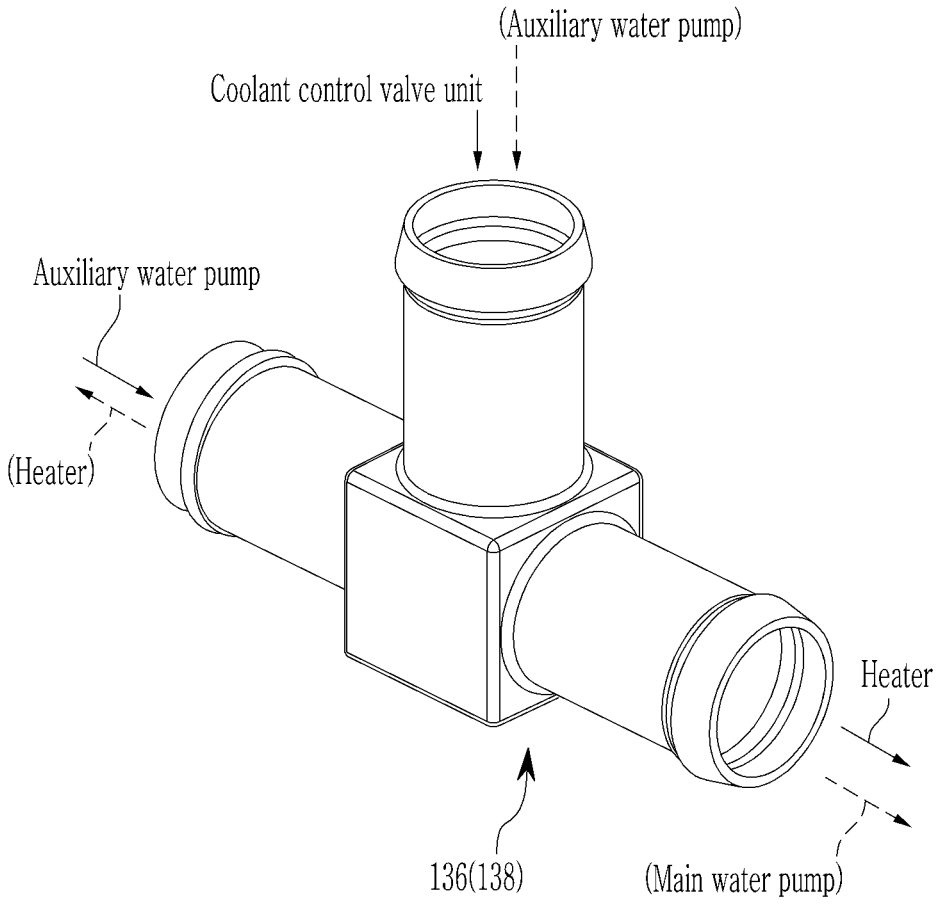
FIG. 12 is a perspective view of a T nipple which may be applied to the cooling system of a hybrid vehicle according to various exemplary embodiments of the present disclosure.

FIG. 11 is a perspective view of an auxiliary water pump which may be applied to the cooling system of a hybrid vehicle according to various exemplary embodiments of the present disclosure, and FIG. 12 is a perspective view of a T nipple which may be applied to the cooling system of a hybrid vehicle according to various exemplary embodiments of the present disclosure.

Referring to FIG. 9, FIG. 11 and FIG. 12, the auxiliary water pump 130 includes a first outlet 132 communicating with the main water pump 120 and a second outlet 134 communicating with the bypass line 60, and a T nipple 136 may be provided at the connection portion of the bypass line 60 and the heater line 50 connecting the front of the heater 52.

When the auxiliary water pump 130 is operating while coolant does not flow to the cooling line 30, the heat-exchange line 40 and the heater line 50, the bypass line 60 connecting the auxiliary water pump 130, the heater 52 and the exhaust heat recovery device 54 forms a closed circuit. Therefore, coolant may flow through the exhaust heat recovery device 54 to prevent damage to the exhaust heat recovery device 54.

Referring to FIG. 9 and FIG. 12, a T nipple 138 communicating with the bypass line 60 may be provided between the auxiliary water pump 130 and the main water pump 120, and a T nipple 136 may be provided at the connection portion of the bypass line 60 and the heater line 50 connecting the front of the heater 52. That is, one outlet of the auxiliary water pump 130 may be configured, and a closed circuit may be configured by applying two T nibbles 136, and 138.

The diameter of the bypass line 60 may be smaller than the diameter of the heater line 50. For example, the heater line 50 may have a diameter of 17 mm, and the bypass line 60 may have a diameter of approximately 14 mm. This increases the flow resistance of the bypass line 60 when coolant is supplied to the heater line 50 so that coolant does not flow to the bypass line 60.

FIG. 13 is a table showing the driving condition and release condition of the auxiliary water pump of the cooling system of the hybrid vehicle according to various exemplary embodiments of the present disclosure.

As shown in FIG. 13, when the controller 100 determines that the current operation mode of the coolant control valve unit 140 corresponds to the flow stop mode or the heat-exchange mode, or the controller 100 determines that the operation mode of the coolant control valve unit 140 goes through the flow stop mode or the heat-exchange mode, the controller 100 may drive the auxiliary water pump 130.

Furthermore, when the controller 100 determines that the driving condition of the auxiliary water pump 130 is not satisfied, the controller 100 determines that the driving release condition of the auxiliary water pump 130 is satisfied, and the controller 100 stops the operation of the auxiliary water pump 130.

Figure 14:
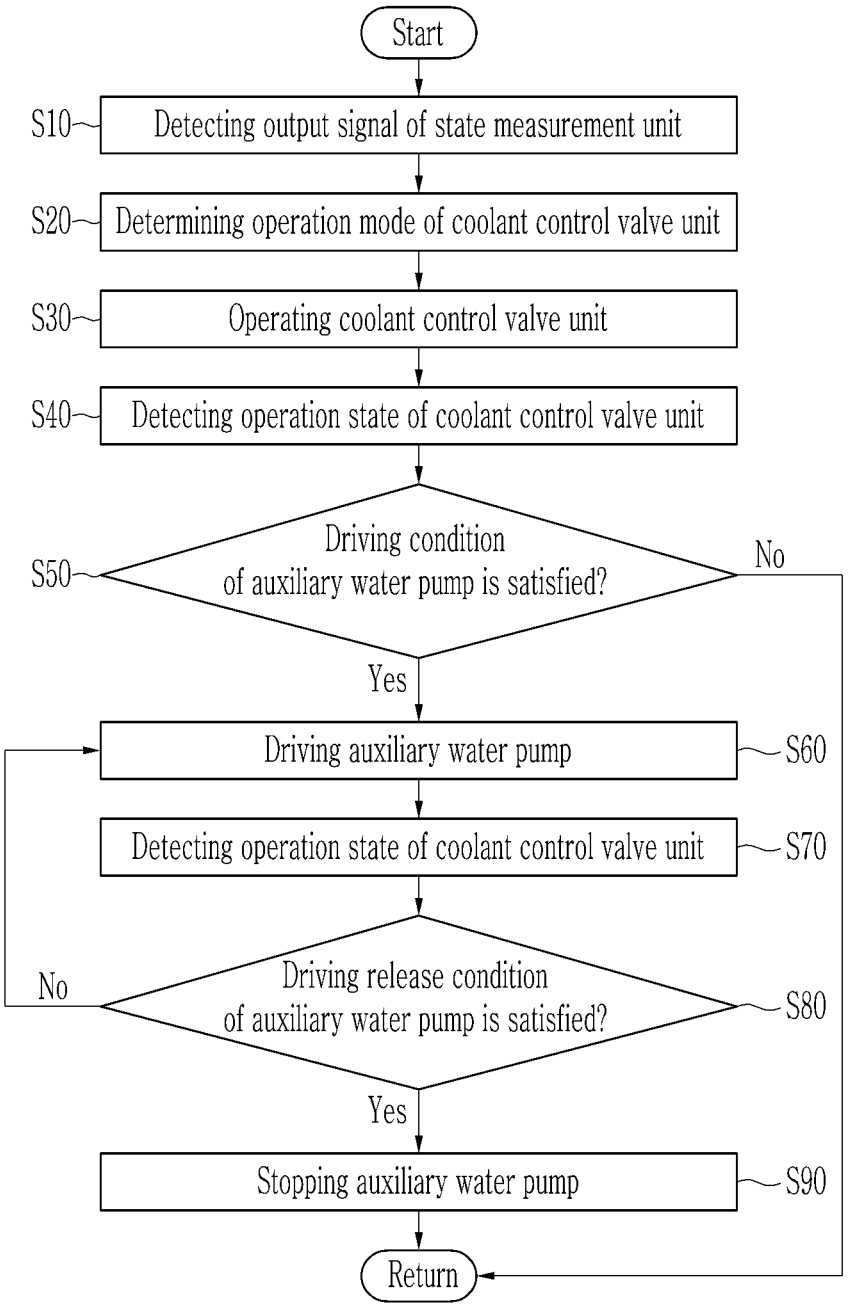
FIG. 14 and FIG. 15 is a flowchart showing a method of controlling a cooling system of a hybrid vehicle according to various exemplary embodiments of the present disclosure.
Figure 15:
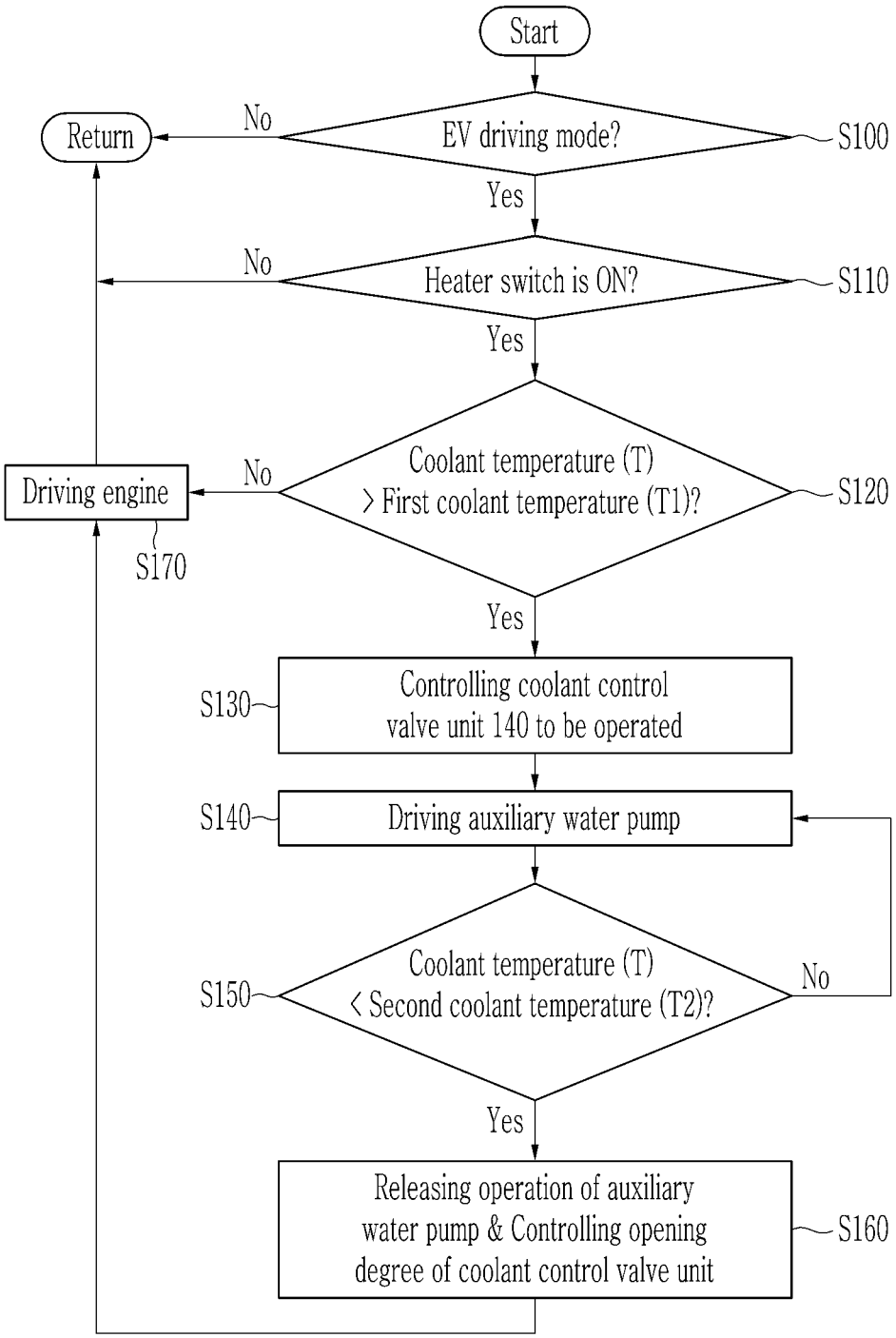

FIG. 14 and FIG. 15 is a flowchart showing a method of controlling a cooling system of a hybrid vehicle according to various exemplary embodiments of the present disclosure.

Referring to FIG. 14, a method of controlling the cooling system of a hybrid vehicle according to various exemplary embodiments of the present disclosure will be described.

The method of controlling the cooling system of the hybrid vehicle according to various exemplary embodiments of the present disclosure may include detecting, by the controller 100, the output signal of the state measurement unit 10 at step S10, determining, by the controller 100, the operation mode of the coolant control valve unit 140 according to the output signal of the state measurement unit 10 at step S20, controlling, by the controller 100, the operation of the coolant control valve unit 140 according to the determined the operation mode at step S30, detecting, by the controller 100, the operation state of the coolant control valve unit 140 at step S40, determining, by the controller 100, whether the predetermined driving condition of the auxiliary water pump 130 is satisfied at step S50, and driving the auxiliary water pump 130 when it is determined by the controller 100 that the driving condition of the auxiliary water pump 130 is satisfied at step S60.

When the operating state of the coolant control valve unit 140 corresponds to the driving condition of the auxiliary water pump 130 shown in FIG. 13, that is, the coolant supply to the heater line 50 is stopped, the controller 100 may output a signal for driving the auxiliary water pump 130.

That is, the predetermined driving condition of the auxiliary water pump 130 may be satisfied when the operation mode of the coolant control valve unit 140 is the heat-exchange mode to supply coolant only to the heat-exchange line 40, or the heating control mode to supply coolant to the heater line 50 with the coolant flow rate of the heat-exchange line 40 maximized, or when the operation mode of the coolant control valve unit 140 goes through the heat-exchange mode or the heating control mode.

The method of controlling the cooling system of the hybrid vehicle according to various exemplary embodiments of the present disclosure may further include detecting, by the controller 100, the operation state of the coolant control valve unit 140 at step S70, determining, by the controller 100, whether the predetermined driving release condition of the auxiliary water pump 130 is satisfied at step S80, and stopping the auxiliary water pump 130 when it is determined by the controller 100 that the driving release condition of the auxiliary water pump 130 is satisfied at step S90.

When the operation state of the coolant control valve unit 140 satisfies the driving release condition of the auxiliary water pump 130 as shown in FIG. 13 the controller 100 determines that the coolant supply of the heater line 50 is restarted, and the controller 100 may output a signal to stop the operation of the auxiliary water pump 130.

That is, when the driving condition of the auxiliary water pump 130 does not correspond to the predetermined driving condition of the auxiliary water pump 130, the predetermined driving release condition of the auxiliary water pump 130 may be satisfied.

As shown in FIG. 14, according to the cooling system of a hybrid vehicle and the control method for the same according to various exemplary embodiments of the present disclosure, it is possible to prevent the coolant supply to the exhaust heat recovery device 54 from being cut off to prevent damage to the exhaust heat recovery device 54.

Referring to FIG. 15, a control method in the EV driving mode of the cooling system of a hybrid vehicle according to various exemplary embodiments of the present disclosure will be described.

The method of controlling the cooling system of the hybrid vehicle according to various exemplary embodiments of the present disclosure may further include determining, by the controller 100, whether a current operation state of the vehicle is an EV driving mode that drives only the drive motor 115 at step S100, determining, by the controller 100, whether the heater switch 52 is in an ON state at step S110 when the current operation state of the vehicle is the EV driving mode, determining, by the controller 100, whether the coolant temperature T of the heater line 50 exceeds a predetermined first coolant temperature T1 at step S120 if the heater switch 52 is in the ON state, controlling, by the controller 100, the coolant control valve unit 140 to be operated in the flow stop mode in which the coolant supply is stopped, or in the heat exchange mode to supply coolant only to the heat-exchange line 40 at step S130 when the coolant temperature T exceeds the predetermined first coolant temperature T1, and driving the auxiliary water pump 130 by the controller 100 at step S140.

In general, the engine is not driven in the EV driving mode, but when the heater switch is in an ON state, the engine is driven to transfer heat to the heater, which may deteriorate fuel efficiency.

However, in the method of controlling the cooling system of the hybrid vehicle according to various exemplary embodiments of the present disclosure, when the heater switch 52 is in an ON state in the EV driving mode, latent heat of the exhaust heat recovery device 54 may remain. Therefore, the controller 100 determines whether the coolant temperature T exceeds the predetermined first coolant temperature T1 at the step S120 and if the coolant temperature T exceeds the first coolant temperature T1, the controller 100 drives the auxiliary water pump 130 to transfer heat to the heater 52 at the step S140.

The coolant temperature T may be the temperature measured through the output signal of the heater line coolant temperature detector 18. Furthermore, the predetermined first coolant temperature T1 may be set to an appropriate temperature capable of transferring heat to the heater 52 without driving the engine 110. For example, the predetermined first coolant temperature T1 may be 70 degrees.

Here, the controller 100 may control the operation of the auxiliary water pump 130 according to a predetermined map, for example, it may be determined according to the user's heating demand performance through the heater switch 52. The map for heating control may be preset in the memory 102, for example.

The method of controlling the cooling system of the hybrid vehicle according to various exemplary embodiments of the present disclosure may further include determining by, the controller 100, whether the coolant temperature T of the heater line 50 is less than a predetermined second coolant temperature T2 at step S150, and releasing, by the controller 100, the operation of the auxiliary water pump 130 and controlling the opening amount of the coolant control valve unit 140 at step S160 if the coolant temperature of the heater line 50 is less than the predetermined second coolant temperature T2.

In the method of controlling the cooling system of the hybrid vehicle according to various exemplary embodiments of the present disclosure, in a process of transferring heat to the heater 52 without driving the engine 110, if the coolant temperature T is less than the second coolant temperature T2, heat cannot be transferred to the heater 52 and heating performance may deteriorate.

For example, the predetermined second coolant temperature T2 may be 60 degrees. That is, the second coolant temperature T2 is set lower than the first coolant temperature T1 to suppress frequent operation changes of the engine 110 and the auxiliary water pump 130.

When the coolant temperature T is less than the second coolant temperature T2, the engine 110 is driven at step S170 to ensure heating performance.

As shown in FIG. 15, according to the method of controlling the cooling system of the hybrid vehicle according to the exemplary embodiments of the present disclosure, when the passenger operates the heater in the EV mode driven only by the operation motor, the fuel efficiency may be improved by minimizing the engine operation.

In various exemplary embodiments of the present disclosure, the control device may be implemented in a form of hardware or software, or may be implemented in a combination of hardware and software.

Furthermore, the terms such as "unit", "module", etc. Included in the specification mean units for processing at least one function or operation, which may be implemented by hardware, software, or a combination thereof.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present disclosure have been presented for purposes of illustration and description. They are not intended to be exhaustive or to limit the present disclosure to the precise forms disclosed, and obviously many modifications and variations are possible in light of the above teachings. The exemplary embodiments were chosen and described to explain certain principles of the present disclosure and their practical application, to enable others skilled in the art to make and utilize various exemplary embodiments of the present disclosure, as well as various alternatives and modifications thereof. It is intended that the scope of the present disclosure be defined by the Claims appended hereto and their equivalents.

What is claimed is:

1. A cooling system of a vehicle, the cooling system comprising:

an engine;

a drive motor;

a main water pump connected to the engine and selectively supplying coolant to the engine;

a cooling line on which a radiator is provided, the cooling line fluidically communicating with the main water pump;

a heat-exchange line on which a heat-exchange device is provided, the heat-exchange line fluidically communicating with the main water pump;

a heater line on which a heater and an exhaust heat recovery device are provided, the heater line fluidically communicating with the main water pump;

a coolant control valve unit fluidically communicating with the engine and selectively supplying the coolant to the cooling line, the heat-exchange line and the heater line;

a bypass line connecting a rear of the exhaust heat recovery device and a front of the heater;

an auxiliary water pump that selectively supplies the coolant from the exhaust heat recovery device to the front of the heater;

a state measurement unit that is configured to measure an operation state of the vehicle and to output an output signal; and a controller configured for controlling operation of the engine, the drive motor, the main water pump, the coolant control valve unit and the auxiliary water pump according to the output signal of the state measurement unit.

2. The cooling system of claim 1, wherein the state measurement unit includes:

an engine coolant temperature detector that is configured to measure a coolant temperature of the engine and to output a corresponding signal to form the output signal;

a heater line coolant temperature detector that is configured to measure a coolant temperature of the heater line and to output a corresponding signal to form the output signal;

an oil temperature detector that is configured to measure an oil temperature and to output a corresponding signal to form the output signal;

an atmosphere temperature detector that is configured to measure an outside air temperature and to output a corresponding signal to form the output signal;

an accelerator pedal detector that is configured to measure an accelerator opening and to output a corresponding signal to form the output signal;

a vehicle speed detector that is configured to measure a vehicle speed and to output a corresponding signal to form the output signal; and a position detector that detects an operation of the coolant control valve unit and to output a corresponding signal to form the output signal, and wherein the controller is configured to control the operation of the coolant control valve unit according to the output signal of the state measurement unit to adjust a coolant supply and an amount of coolant supply in the cooling line, the heat-exchange line and the heater line.

3. The cooling system of claim 2, wherein the controller is configured to output a signal for driving the auxiliary water pump, when the controller concludes that the coolant supply of the heater line is stopped according to the output signal of the state measurement unit.

4. The cooling system of claim 2, wherein the controller is configured to control the operation of the coolant control valve unit according to a plurality of operation modes of the coolant control valve unit, and wherein the plurality of operation modes includes:

a heating priority mode to supply the coolant only to the heater line;

a flow stop mode to stop the coolant supply;

a heat-exchange mode to supply the coolant only to the heat-exchange line;

a heating control mode to supply the coolant to the heater line while maximizing a coolant flow rate of the heat-exchange line;

a coolant temperature control mode to supply the coolant to the cooling line while maximizing the coolant flow rate of the heat-exchange line and the heater line; and a maximum cooling mode to maximize coolant flow to the heat-exchange line, the heater line and the cooling line.

5. The cooling system of claim 4, wherein when the controller concludes that a current operation mode of the coolant control valve unit corresponds to the flow stop mode or the heat-exchange mode, or the controller concludes that the current operation mode of the coolant control valve unit goes through the flow stop mode or the heat-exchange mode, the controller is configured to drive the auxiliary water pump.

6. The cooling system of claim 1, wherein the auxiliary water pump includes:

a first outlet fluidically communicating with the main water pump; and a second outlet fluidically communicating with the bypass line, wherein a T nipple is provided at a connection portion of the bypass line and the heater line connecting the front of the heater.

7. The cooling system of claim 1, further including:

a first T nipple fluidically communicating with the bypass line provided between the auxiliary water pump and the main water pump; and a second T nipple provided at a connection portion of the bypass line and the heater line connecting the front of the heater.

8. The cooling system of claim 1, wherein a diameter of the bypass line is smaller than a diameter of the heater line.

9. The cooling system of claim 1, wherein the heat-exchange device includes at least one of an oil warmer and an Automatic Transmission Fluid (ATF) warmer.

10. A method of controlling the cooling system of claim 1, the method comprising:

determining, by the controller, an operation mode of the coolant control valve unit according to the output signal of the state measurement unit;

controlling, by the controller, an operation of the coolant control valve unit according to the output signal of the state measurement unit;

detecting, by the controller, an operation state of the coolant control valve unit;

determining, by the controller, whether a predetermined driving condition of the auxiliary water pump is satisfied; and driving the auxiliary water pump when the controller concludes that the predetermined driving condition of the auxiliary water pump is satisfied.

11. The method of claim 10, further including:

detecting, by the controller, the operation state of the coolant control valve unit;

determining, by the controller, whether a predetermined driving release condition of the auxiliary water pump is satisfied; and stopping the auxiliary water pump when the controller concludes that the driving release condition of the auxiliary water pump is satisfied.

12. The method of claim 11, wherein the predetermined driving condition of the auxiliary water pump is satisfied, when the operation mode of the coolant control valve unit is a heat-exchange mode to supply the coolant only to the heat-exchange line, or a heating control mode to supply the coolant to the heater line with a coolant flow rate of the heat-exchange line maximized, or when the operation mode of the coolant control valve unit goes through the heat-exchange mode or the heating control mode.

13. The method of claim 12, wherein when a driving condition of the auxiliary water pump does not correspond to the predetermined driving condition of the auxiliary water pump, the predetermined driving release condition of the auxiliary water pump is satisfied.

14. The method of claim 10, further including:

determining, by the controller, whether a current operation state of the vehicle is an EV driving mode to drive only the drive motor;

determining, by the controller, whether a heater switch is in an ON state when the current operation state of the vehicle is the EV driving mode;

determining, by the controller, whether a coolant temperature of the heater line exceeds a predetermined first coolant temperature when the heater switch is in the ON state;

controlling, by the controller, the coolant control valve unit to be operated in a flow stop mode in which coolant supply is stopped, or in a heat exchange mode to supply the coolant only to the heat-exchange line when the coolant temperature exceeds the predetermined first coolant temperature; and driving the auxiliary water pump by the controller.

15. The method of claim 14, further including:

determining, by the controller, whether the coolant temperature of the heater line is less than a predetermined second coolant temperature; and releasing, by the controller, operation of the auxiliary water pump and controlling an opening amount of the coolant control valve unit when the coolant temperature of the heater line is less than the predetermined second coolant temperature.

16. The method of claim 15, wherein the second coolant temperature is lower than the first coolant temperature.

* * * * *